US005400684A

United States Patent [19]

Duffy

[11] Patent Number: 5,400,684

[45] Date of Patent: Mar. 28, 1995

[54] TREMOLO BAR

[76] Inventor: Michael Duffy, 2547 Sunset Dr. West, Tacoma, Wash. 98466

[21] Appl. No.: 855,289

[22] Filed: Mar. 23, 1992

[51] Int. Cl.[6] ..... G10D 3/00
[52] U.S. Cl. ..... 84/313
[58] Field of Search ..... 84/307, 313, 298

[56] References Cited

U.S. PATENT DOCUMENTS 1,775,089 9/1930 De Costa ..... 84/313
4,852,448 8/1989 Hennessey ..... 84/313

*Primary Examiner*—Michael L. Gellner
*Assistant Examiner*—P. Stanzione

[57] ABSTRACT

A hip-activated tremolo bar for a guitar which extends from the back of the guitar is illustrated. A curved stop and a securing pin provides a limit for the forward movement of the bridge when the hip-activated tremolo bar is used.

2 Claims, 3 Drawing Sheets

TREMOLO BAR

SUMMARY OF THE INVENTION

The present invention is a device used to vary the frequency output of sound from a guitar, thus producing a vibrating or tremulous sound effect. This device is commonly called a tremolo bar. The uniqueness of the present invention is found in the fact that the tremolo bar extends from the back of the guitar; more precisely, from the side of the guitar held against the musician. The advantage of having the tremolo bar extend from the back of the guitar is that the musician can operate the tremolo bar with his hip, thus leaving his hands free to pay the guitar.

BACKGROUND OF THE INVENTION use of a tremolo bar is widespread by guitar players. However, previous bars extend from the front of the guitar or more precisely, from the, side of the guitar along which the strings run. This requires the user to play the bar with either a hand or an arm.

In the present invention, the tremolo bar extends from the back of the guitar, or from the side of the guitar opposite the side of the guitar along which the strings run. By extending from the rear of the guitar, the tremolo bar may be played by depressing the bar against a leg, side or other part of the user's body, thereby leaving both hands free.

DETAILED DESCRIPTION OF THE DRAWINGS

Figure 1:
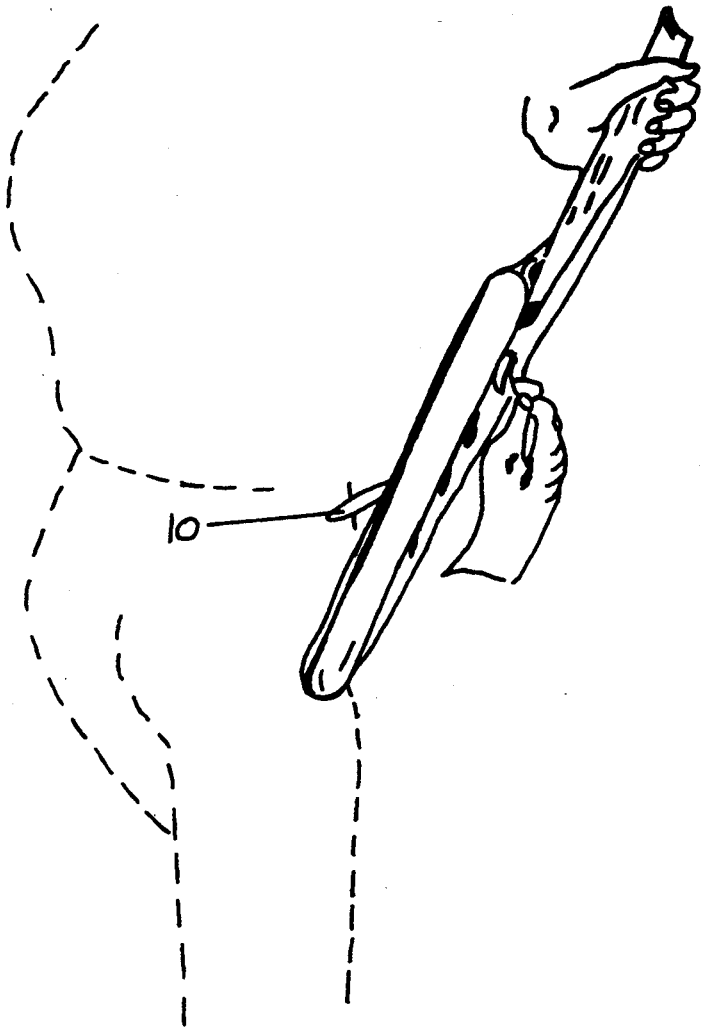
FIG. 1 is a perspective view of the tremolo bar being depressed against the side of a guitar player.

A perspective view of a guitar player using the hip-activated tremolo bar 10 is illustrated in FIG. 1. As can be seen from FIG. 1, the device eliminates the need for the common hand controlled tremolo bar, thereby freeing the user's strumming or picking hand. It is understood that a person's knee or any other solid object is equally effective as a person's hip.

Figure 2:
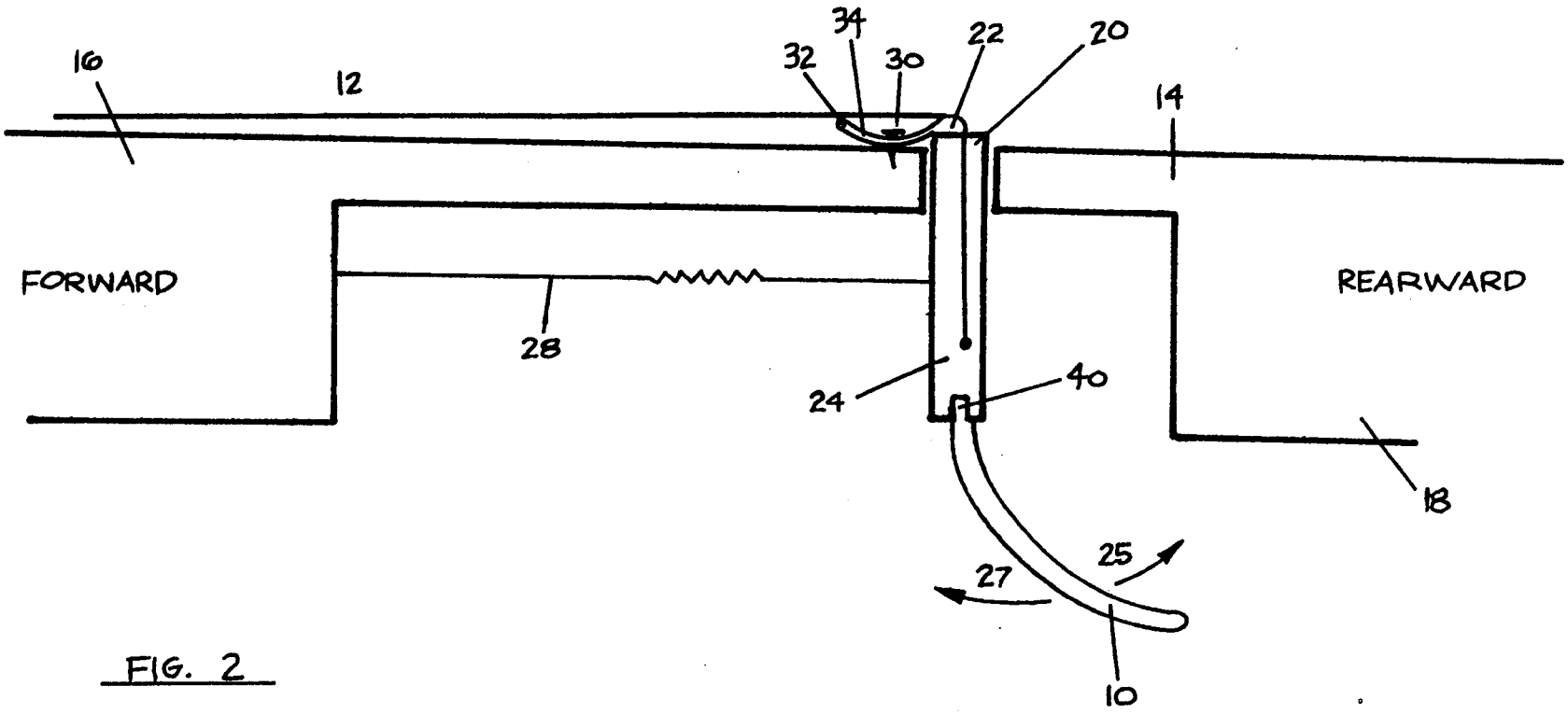
FIG. 2 is a side cutaway view of a guitar illustrating the potential effect of depressing a tremolo bar on the strings of the guitar, thereby releasing the tension on the strings.
Figure 4:
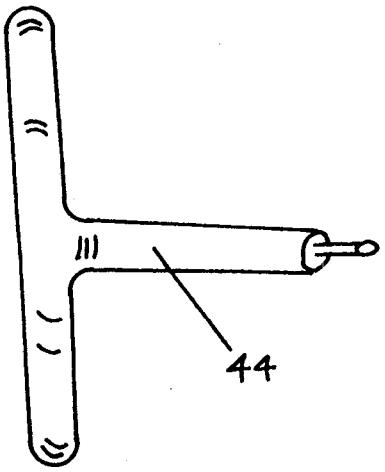
FIG. 4 is a perspective view of a "T-shaped" tremolo bar.

A side view of the preferred embodiment of the hip-activated tremolo bar is set forth in FIG. 2. In order to accomplish the effect of a tremolo bar, the user must alternately release and tighten the tension on the guitar strings 12.

The guitar 14 has two sides, front 16 and back 18. The front side of the guitar is defined as the side of the guitar along which the strings run. The bar 10 extends from the rear 18 of the guitar.

The strings 12 extend over the bridge 20 and bridge string holder 22. In the preferred embodiment, the bridge 20 includes an extension 24 which passes from the front 16 through to the back 18 of the guitar. Attached to the end of the bridge extension near the back 18 of the guitar is tremolo bar 10. To activate the tremolo bar 10, the user merely pushes in and out against the tremolo bar 10. By applying this pressure, the user causes the bridge 20 to rotate, as illustrated by directional arrows "25". As illustrated, the spring can rock back and forth.

As an opposing force to the bar 10 are springs 28. When there is no pressure exerted against the bridge 20 the springs pivot the bridge to a position approximately 90 degrees in relation to the front 16 plane of the guitar.

When the tremolo bar is depressed by pressure from the user, the tremolo bar 10 which is attached to the bridge extension 24, causes the bridge to pivot forward thereby releasing tension on strings 12. When pressure is released from the tremolo bar, the springs pull the bridge into the approximate 90 degree position. When the user alternately and rapidly depresses and releases the tremolo bar, the frequency output of the strings produce a vibratory or tremulous effect.

It also should be understood that the user can deflect the direction of the bridge extension as shown in directions arrow 27.

As set forth in FIG. 2, the strings 12 extend over the bridge string holder 22, and extend through the bridge extension 24. The curved stop 32 is held in position by securing pin 30. The securing pin 30 is affixed to the front 16 of the guitar. The curved stop 32 provides a limit for the forward movement of the bridge. This is accomplished by the cut-out 34 within the curved stop 32 bumping up against pin 30.

As set forth in FIG. 2, a curved stop 32 is attached to bridge string holder 22. The curved stop then extends along the forward plane of the guitar in a curved manner, curving down from the bridge 22 to the forward plane 16 and then curving back up.

A slot 34 is cut within the curved stop 32. The slot allows for pin 30 to be placed through the slot 34 and be secured to the front 16 of the guitar.

The curved slot provides a limit for the forward movement of the bridge. This is accomplished by the slot 34 bumping up against pin 30. The curved stop also provides a guide for the bridge as it rotate.

A number of guitars use a classic knife edge configuration to allow for the movement of the bridge rather the curved stop 32 set forth herein.

Figure 3:
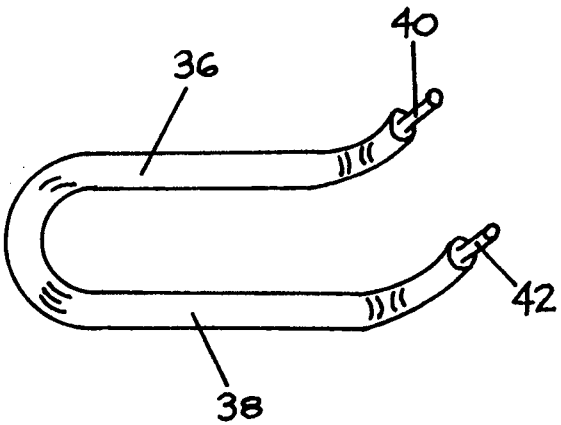
FIG. 3 is a perspective view of the tremolo bar.

In FIG. 3 a perspective view of the tremolo bar is illustrated. The tremolo bar is designed in a general "U" configuration with two sides 36 and 38. Each of the sides have fittings 40 and 42 which are capable of being inserted within the bridge extension 24.

Although in the preferred embodiment the tremolo bar is configured in a "U" configuration, the bar is an appendage that can take several different shapes such as a "T" shape 44 or other configurations. The criteria of the bar 10 is that it can butt up against a person or object in order to produce the vibratory effect.

I claim:

1. A device for causing a variation in frequency on a string instrument such as a guitar comprising:

a string instrument bridge which provides a connection for the strings of the instrument;

an extension from said bridge which runs to the back of the string instrument;

a bar capable of attaching to the bridge extension wherein the bar is designed in a "T" shape, the perpendicular portion of the "T" capable of attaching to the bridge extension;

a pin affixed to the forward side of a guitar near the strings;

a curved stop including a partial slot wherein the pin is capable of sliding within the slot, but the slot also confines its travel due to its striking either end of the slot;

a means for attaching the curved slot to the bridge;

a spring affixed to the housing of the instrument and the bridge whereby when the tension is released from the bar, the bridge returns to its previous position.

2. The device of claim 1 wherein the bar is designed in a "U" shape, both ends of the "U" being capable of being affixed to the bridge extension.

* * * * *